United States Patent [19]

Stauffer

[11] 4,326,508

[45] Apr. 27, 1982

[54] MASSAGING DEVICE

[76] Inventor: Robert Stauffer, Glattalstrasse 150, Rumlang, Switzerland, CH-8153

[21] Appl. No.: 152,660

[22] Filed: May 23, 1980

[30] Foreign Application Priority Data

Jun. 7, 1979 [CH] Switzerland ..... 5306/79

[51] Int. Cl.[3] ..... C13D 1/06

[52] U.S. Cl. ..... 128/57; 128/60; 401/195; 401/212; 401/213

[58] Field of Search ..... 128/57, 60, 64, 56; 401/209, 212, 213, 195

[56] References Cited

U.S. PATENT DOCUMENTS

| | | | |
|---|---|---|---|
| 781,555 | 1/1905 | Schanz | 128/57 |
| 915,251 | 3/1909 | Vanderslice | 128/60 |
| 1,947,042 | 2/1934 | Glennan | 128/57 |
| 2,103,261 | 12/1937 | Hughes | 128/57 |
| 3,081,768 | 3/1963 | Rosenberg | 128/57 |

FOREIGN PATENT DOCUMENTS

| | | | |
|---|---|---|---|
| 805541 | 3/1951 | Fed. Rep. of Germany | 128/57 |
| 770825 | 9/1934 | France | 128/57 |
| 1171617 | 1/1959 | France | 128/57 |
| 618413 | 3/1961 | Italy | 128/57 |
| 30265 | of 1910 | United Kingdom | 128/60 |
| 12262 | of 1914 | United Kingdom | 128/57 |

*Primary Examiner*—Richard C. Pinkham
*Assistant Examiner*—T. Brown
*Attorney, Agent, or Firm*—Tilton, Fallon, Lungmus & Chestnut

[57] ABSTRACT

A manual massaging device having a ball-equipped plate which is centrally apertured for the receipt of a massaging oil containing container which has a dispensing ball at the top and which serves as a handle for the plate during massage.

5 Claims, 3 Drawing Figures

FIG. 2
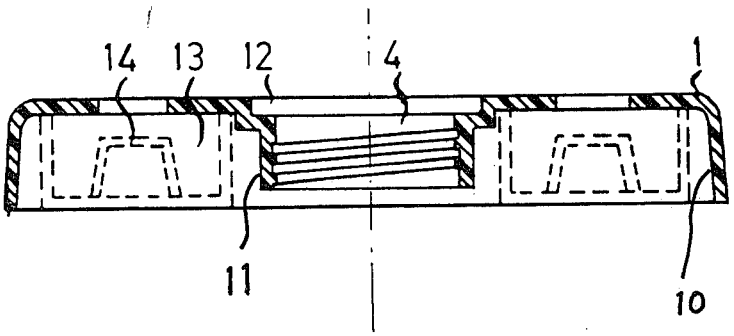
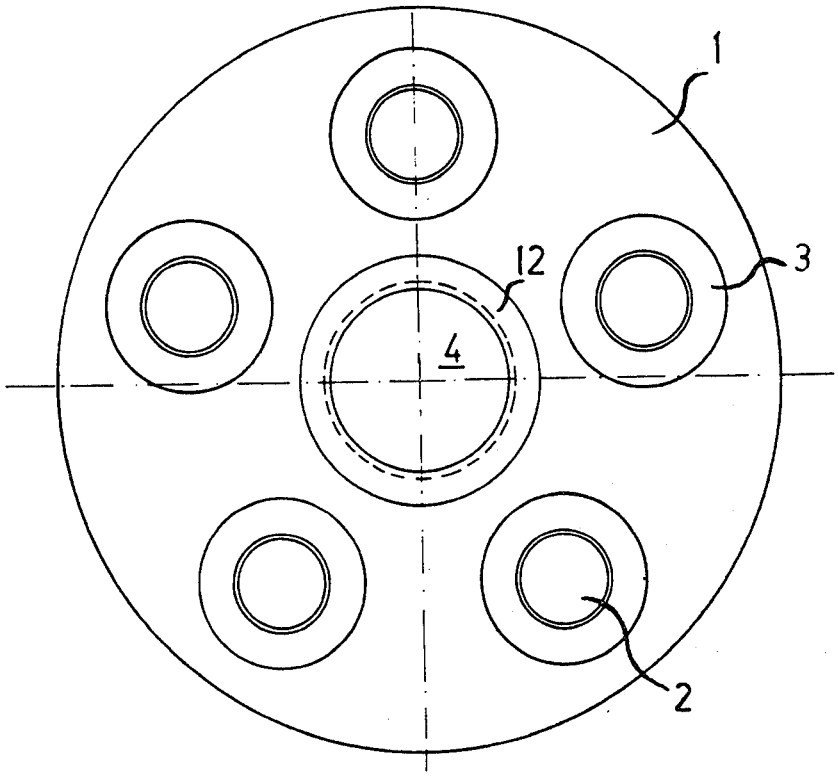
FIG. 3

MASSAGING DEVICE

BACKGROUND OF INVENTION

This invention concerns a manual massaging device with a base plate and several balls located in the plate and used in the massage.

A multitude of massaging devices can be found on the market, some of which are motorized, while others are manually operated. In particular, foot massaging devices are known in which several balls are set in a mounting plate. The user moves his feet over the balls.

Aromatic and therapeutic massaging oils are often used in traditional hand massages. Up until now this was not possible when massaging devices were used since the oils soiled the massaging devices which were then extremely difficult to clean. Masseuses often complained about how messy their hands got. The dosage of the massaging oil is also extremely problematic.

Although so-called "roll-on sticks" are well known for their use in deodorants, massage oils have not been applied in this form.

This invention has as its goal devising a manual massaging device which is suitable for use with massage oil and besides this makes it possible to apply a specific dose—without making the hands greasy.

SUMMARY OF INVENTION

This goal is met by a manual massaging device with a base plate and several balls which are mounted in the plate and are used in the massage. The peculiarity of such a device lies in the fact that the ball or roll holder is a plate with a central, internally threaded flange, around which several balls with capsular housings of frusto conical shape are evenly distributed, while a removable container, which at the same time serves as a handle, is screwed into the threaded flange, so that when the container is screwed in an applicator roll which is part of the container sticks through the roll holder.

One example of a massaging device built according to the invention is presented in the drawing, which is explained in the following description.

FIG. 2 shows a top plan view of the roll holder; and

FIG. 3 shows a sectional view of the roll holder along line x—x of FIG. 2.

DETAILED DESCRIPTION

Figure 1:
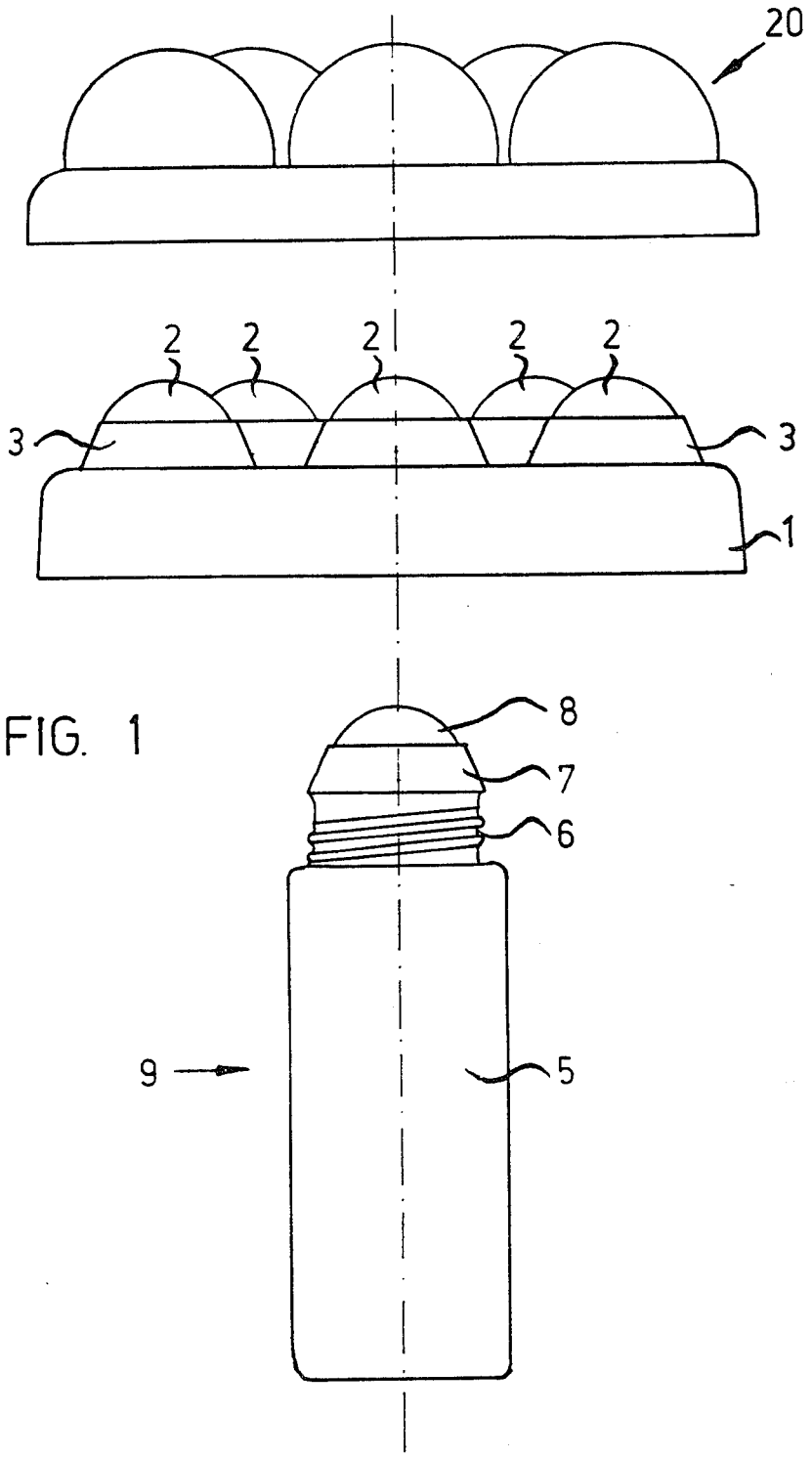
FIG. 1 shows the massaging device's separate parts in a side elevational, exploded view.

The manual massaging device has as its chief component a base plate, hereafter referred to as roll holder 1, and several solid balls or rolls 2, connected with the roll holder and moveably mounted in capsular housings 3. A central threaded hole 4 (see FIG. 3) is used for the insertion of a container 5 which can be filled with massaging oil and which includes a threaded section 6 which matches the threaded hole 4 and a capsular housing 7 with an applicator roll 8. The container 5 with its parts 6–8 is referred to in its entirety as the "roll-on stick" 9. The roll-on stick can be covered by a screw-on top or cap (not shown in the drawing) so that the applicator roll does not stick in the capsular housing due to hardening oil. The container 5 also acts here as a handgrip for the massaging device.

The roll holder 1, which is preferably made of a plastic which does not irritate the skin, has a collar or flange 10 (see FIG. 2) on its edge in order to protect the masseuse and/or the person being massaged from possible abrasions. The threaded hole 4 into which the roll-on stick 9 is inserted is placed inside a flange 11. On the side with the rolls, the holder 1 is provided with a slight depression 12 around the threaded hole 4. In this way it is possible to visually check to make sure that the roll 8 of the roll-on stick is set back relative to the rolls 2. With this arrangement the dosage of the massage oil can be altered through the variation of the pressure of the massaging device on the body of the person being massaged. At the normal massage pressure the roll 8 hardly touches the skin, if at all; and thus no massage oil is applied.

The rolls 2 and the capsular housings 3 form a structural unit which can be pressed into cavities 13 with form-fitting centers 14 which are provided in the roll holder.

In order to also protect the rolls 2 in their capsular housings 3 from the hardening of massage oil, a cover 20 is provided. The cover 20 is shaped to closely fit over the roll holder 1 and forms as air-tight a top as possible. The cover also has the function of protecting the surroundings from the rolls 2 when those are greasy from massage oil. This is especially advantageous, since the cover 20, with its special form (i.e., frusto spherical projections) is ideally suited for massages through clothes. The plastic cover 20 has good gliding qualities not only on skin but also on textiles.

The arrangement of the rolls 2 on the roll holder 1 can be seen in FIG. 2. Five capsular housings 3 are distributed evenly around a circle' both the arrangement and the number are advantageous. Only when the rolls 2 are evenly distributed will there be an even massage effect, which guarantees that the entire skin surface is evenly treated. If too many rolls 2 are set in the base plate 1, the working surface becomes too large, so that too much pressure is required to make the applicator roll 8 work. In spite of this, variations of the roll size are possible.

It is clear that the device can be used not only for working in massage oils, but is in principle suited for all types of skin-care, pharmaceutical, and cosmetic products.

I claim:

1. A manual massaging device comprising a base plate (1) having an upper surface and a central, threaded hole (4), a plurality of massaging balls (2) rollably mounted in said base plate in concentric, evenly spaced relation to said hole, and applicator container (5) for massaging oil equipped with an applicator ball (8) at its upper end threadably mounted in said hole and projecting downwardly away from said plate to provide a manipulating handle therefor.

2. The device of claim 1 in which said container (5) is constructed and arranged relative to said plate that in its fully threaded position, the top of the applicator ball is recessed relative to the tops of said massaging balls.

3. The device of claim 1 in which said plate is equipped with a central interior, depending flange (11) about said hole, the upper end of said flange (12) being spaced below the upper surface of said plate.

4. The device of claim 1 in which said plate is equipped with a depending perimetric flange (10).

5. The device of claim 1 in combination with a cover removably mounted thereon and constructed of plastic material to provide a gliding function when oil-less massage is performed through clothing.

* * * * *